US009920596B2

(12) United States Patent
Dong et al.

(10) Patent No.: US 9,920,596 B2
(45) Date of Patent: Mar. 20, 2018

(54) COAL BED METHANE RECOVERY

(75) Inventors: Shuxing Dong, Beijing (CN); Thomas J. Wheeler, Houston, TX (US); W. Reid Dreher, Jr., College Station, TX (US)

(73) Assignee: CONOCOPHILLIPS COMPANY, Houston, TX (US)

( * ) Notice: Subject to any disclaimer, the term of this patent is extended or adjusted under 35 U.S.C. 154(b) by 47 days.

(21) Appl. No.: 12/944,569

(22) Filed: Nov. 11, 2010

(65) Prior Publication Data

US 2011/0120708 A1 May 26, 2011

Related U.S. Application Data

(60) Provisional application No. 61/263,528, filed on Nov. 23, 2009.

(51) Int. Cl.
*E21B 43/00* (2006.01)
*E21B 43/24* (2006.01)

(52) U.S. Cl.
CPC ..... *E21B 43/006* (2013.01); *E21B 43/2401* (2013.01)

(58) Field of Classification Search
None
See application file for complete search history.

(56) References Cited

U.S. PATENT DOCUMENTS 4,043,395 A * 8/1977 Every ..... E21F 7/00 166/268
4,140,180 A 2/1979 Bridges et al.
4,193,448 A 3/1980 Jeambey
4,199,025 A * 4/1980 Carpenter ..... 166/248
4,435,374 A 3/1984 Helm, Jr.
4,537,252 A * 8/1985 Puri ..... 166/245
5,076,727 A 12/1991 Johnson et al.
5,299,887 A 4/1994 Ensley
5,402,847 A * 4/1995 Wilson ..... E21B 43/006 166/266
5,462,116 A * 10/1995 Carroll ..... 166/249
5,501,279 A * 3/1996 Garg et al. ..... 166/372
6,012,520 A 1/2000 Yu et al.
6,023,554 A 2/2000 Vinegar et al.
7,055,599 B2 6/2006 Kasevich
7,091,460 B2 8/2006 Kinzer
(Continued)

FOREIGN PATENT DOCUMENTS

GB 896407 5/1960
GB 1567129 5/1980
(Continued)

OTHER PUBLICATIONS

"Joule heating" retrieved Feb. 24, 2014 from http://en.wikipedia.org/wiki/Joule_heating.*
(Continued)

*Primary Examiner* — Angela M DiTrani
(74) *Attorney, Agent, or Firm* — ConocoPhillips Company

(57) ABSTRACT

In-situ heating of coal facilitates desorption and diffusion of the methane for production of the methane through a wellbore. Water within fractures of the coal forms an electrical conduit through which current is passed. The heating relies at least in part on resistivity of the water, which thereby preheats the coal for the recovering of the methane.

13 Claims, 2 Drawing Sheets

(56) References Cited

U.S. PATENT DOCUMENTS

| | | | | |
|---|---|---|---|---|
| 7,096,941 | B2 | 8/2006 | de Rouffignac et al. | |
| 7,331,385 | B2 | 2/2008 | Symington et al. | |
| 2007/0131591 | A1 | 6/2007 | Pringle | |
| 2007/0246994 | A1 | 10/2007 | Kaminsky et al. | |
| 2008/0087428 | A1 | 4/2008 | Symington et al. | |
| 2008/0190813 | A1 | 8/2008 | Dana et al. | |
| 2008/0230219 | A1* | 9/2008 | Kaminsky | 166/248 |
| 2008/0289819 | A1 | 11/2008 | Kaminsky et al. | |

FOREIGN PATENT DOCUMENTS

| | | |
|---|---|---|
| WO | WO2005093210 | 10/2005 |
| WO | WO2007084763 | 7/2007 |
| WO | WO2007099315 | 9/2007 |

OTHER PUBLICATIONS

Fuchs et al., "Theory of Coal Pyrolysis," May 1942, Industrial Engineering and Chemistry, vol. 34, No. 5, pp. 567-571.*

Yang et al., "Review of advance on coal pyrolysis mechanism," 2014, Journal of Chemical and Pharmceutical Research, 2014, 6(3), 421-423.*

* cited by examiner

COAL BED METHANE RECOVERY

CROSS-REFERENCE TO RELATED APPLICATIONS

This application is a non-provisional application which claims benefit under 35 USC § 119(e) to U.S. Provisional Application Ser. No. 61/263,528 filed Nov. 23, 2009, entitled "COAL BED METHANE RECOVERY."

STATEMENT REGARDING FEDERALLY SPONSORED RESEARCH OR DEVELOPMENT

None

FIELD OF THE INVENTION

Embodiments of the invention relate to methods of recovering coal bed methane.

BACKGROUND OF THE INVENTION

Coal beds often contain hydrocarbon gases in which a main component is methane. However, production of the methane utilizing wells drilled into the coal beds relies on desorption of the methane from surfaces of solid coal forming a matrix system of the coal bed. Past techniques to recover the methane remove water from open fractures forming a cleat system extending through the coal beds such that with the removal of the water the methane desorbs due to subsequent pressure reduction. In contrast to such desorption processes to recover the methane already present in the coal bed, other methods convert the coal in-situ to produce hydrocarbons based on pyrolysis of the coal.

The methane that desorbs flows through the cleat system to the wells for recovery. Once the water is removed, limited permeability of the cleat system and slow or incomplete desorption results in some of the methane being trapped and unrecovered. Recovery levels may still fail to be economical or reach maximum achievable quantities even with various different prior approaches that attempt to enhance total recovery of the methane and that may be implemented after this initial dewatering and primary recovery of the methane.

Therefore, a need exists for improved methods of recovering coal bed methane.

SUMMARY OF THE INVENTION

In one embodiment, a method includes passing electric current through water from a first well to a second well by applying a voltage across the first and second wells. The current results in resistive heating of the water within a formation containing coal. The method further includes recovering methane desorbed from the coal due to the coal being heated by the water and without the coal being heated above a pyrolysis temperature of the coal.

According to one embodiment, a method includes passing electric current between electrodes having a voltage difference applied and disposed spaced apart in a formation containing coal. The current passes through water within the formation for resistive heating of the water. In addition, recovering fluids that include both the water and methane desorbed from the coal as facilitated by preheating the coal due to the resistive heating followed by dewatering of the formation during the recovering.

For one embodiment, a method includes passing electric current through water from a first well to a second well by applying a voltage across the first and second wells for resistive heating of the water within a formation containing coal, prior to initial dewatering that removes the water occurring natural within the formation. The method also includes recovering methane desorbed from the coal concurrent with the initial dewatering of the formation. Further, temperature increase of the coal to facilitate desorption of the methane during the recovering is limited based on an in-situ boiling point of the water.

BRIEF DESCRIPTION OF THE DRAWINGS

The invention, together with further advantages thereof, may best be understood by reference to the following description taken in conjunction with the accompanying drawings.

DETAILED DESCRIPTION OF THE INVENTION

Embodiments of the invention relate to recovering coal bed methane. In-situ heating of coal facilitates desorption and diffusion of the methane for production of the methane through a wellbore. Water within fractures of the coal forms an electrical conduit through which current is passed. The heating relies at least in part on resistivity of the water, which thereby preheats the coal for the recovering of the methane.

Figure 1:
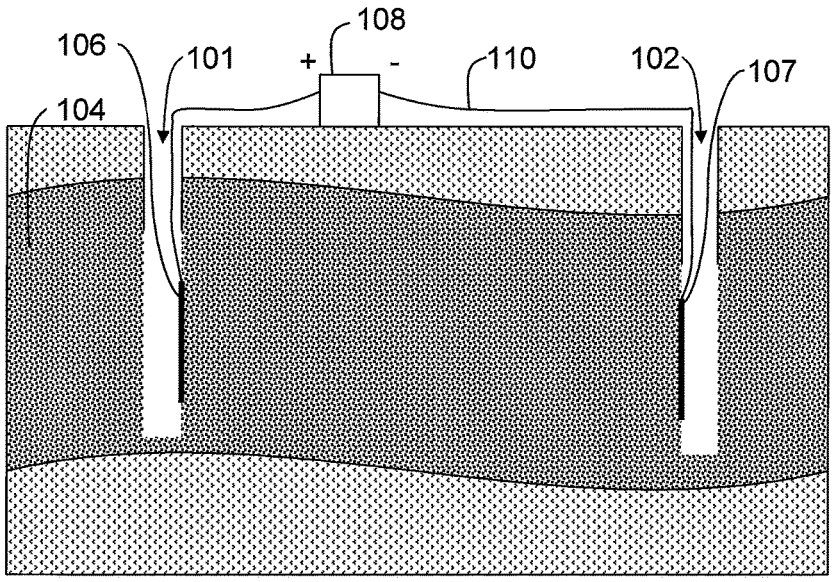
FIG. 1 is a schematic of a production system for recovering coal bed methane, according to one embodiment of the invention.

FIG. 1 shows a production system having a first well 101 and a second well 102 each intersecting a subterranean formation 104 that contains coal. The formation 104 further includes water within fractures throughout the coal. In some embodiments, the water exists natural in the formation and defines an electrical conduit between the first and second wells 101, 102. Spacing between the first well 101 and the second well 102 depends on characteristics of the formation and enables electrical communication between the first and second wells 101, 102. For example, at least about 100 meters (m), at least about 200 m, or at least about 300 m may separate the first well 101 from the second well 102.

The first and second wells 101, 102 include respective first and second electrodes 106, 107 in electrical contact with the formation 104. The first and second electrodes 106, 107 couple to a voltage source 108 via cables 110 defining a circuit. The first electrode 106 couples to a positive output of the voltage source 108 while the second electrode 107 couples to a negative output of the voltage source 108. The voltage source 108 may supply alternating or direct current to the first and second electrodes 106, 107 thereby establishing a voltage or electric potential between the first well 101 and the second well 102.

In operation, electric current passes between the first and second electrodes 106, 107 for resistive heating of the water within the formation 104. Heat from the water transfers to the coal without the coal in some embodiments being heated above a pyrolysis temperature of the coal. Keeping temperature of the coal below the pyrolysis temperature still facilitates desorption of methane even though compositional changes of the coal due to chemical reactions may at least be limited. Temperature of the coal between the first and second wells 101, 102 upon being heated in some embodiments stays below a maximum of about 100° C. or about 200° C., such as between about 50° C. and about 150° C., prior to and during the recovering.

For some embodiments, the water and coal in the formation 104 remain below an in-situ boiling point of the water upon recovering of the methane desorbed from the coal due to the coal being heated. Avoiding vaporization of the water prior to recovering the methane ensures that the electrical conduit between the first and second electrodes 106, 107 is not broken such that desired heating spans between the first and second wells 101, 102. The resistive heating of the water can thus extend at least about 100 m, at least about 200 m, or at least about 300 m away from each of the first and second wells 101, 102.

Dewatering of the formation 104 removes the water after the coal has been heated. Since methane desorption is both temperature and pressure dependent, more gas becomes free when both the temperature of the coal increases and the pressure in the formation 104 decreases than if just relying on pressure reduction alone. In addition, the matrix system shrinks relative to amount of the methane that desorbs and results in increasing permeability of the cleat system. For some embodiments, the dewatering of the formation 104 takes place concurrent with the recovering of the methane. The water and methane migrates through the cleat system of the formation 104 and are produced at either or both of the wells 101, 102. Acceleration of the methane desorption benefits production and recovery of the methane.

In some embodiments, a gas injected into the formation 104 through the first well 101 helps drive the methane toward the second well 102 where recovered. Examples of the gas include carbon dioxide, nitrogen and mixtures thereof. The gas that is injected may possess a higher affinity to the coal than the methane such that the methane displaced from the coal by reactive absorption of the gas further contributes to methane recovery totals. Injection of the gas may provide a use for waste streams, such as carbon dioxide in flue gas, without requiring additional energy input just to achieve higher values for the methane recovery totals.

Following the dewatering, water replacement for some embodiments facilitates driving out the methane that is desorbed. For example, water injection back into the formation 104 through the first well 101 causes migration of the methane toward the second well 102 where recovered. Since the electrical conduit between the first and second electrodes 106, 107 is reestablished, such water replacement also enables cycling of the water injection, the resistive heating by the applying of the voltage across the first and second wells 101, 102, the dewatering and the recovering of the methane. The cycling may continue until the methane recovery totals achieved with each cycle decline to a point where the cycling becomes uneconomical.

In some embodiments, auxiliary heat or energy sources supplement heating of the formation 104 even if supplemented only close to the wells 101, 102 relative to achievable distances heated with the resistive heating of the water in the formation 104. For example, use of resistive heating elements located in thermal proximity to the formation 104 or directing electromagnetic energy, such as radio frequency or microwave energy, from an antenna or waveguide into the formation 104 can contribute to the coal being heated. The electric current being passed through the formation 104 may result in the coal being heated overlapping and beyond penetration of the microwave energy into the formation 104 such that the coal is heated as far out and as efficient as possible through a combination of heating approaches. Following the initial dewatering, the microwave energy if used to heat flow of the replacement water being reintroduced into the formation 104 may provide heat carried further into the formation 104 than penetration distance of the microwave energy, even though additional subsequent heating of the replacement water may utilize the electrodes 106, 107.

Figure 2:
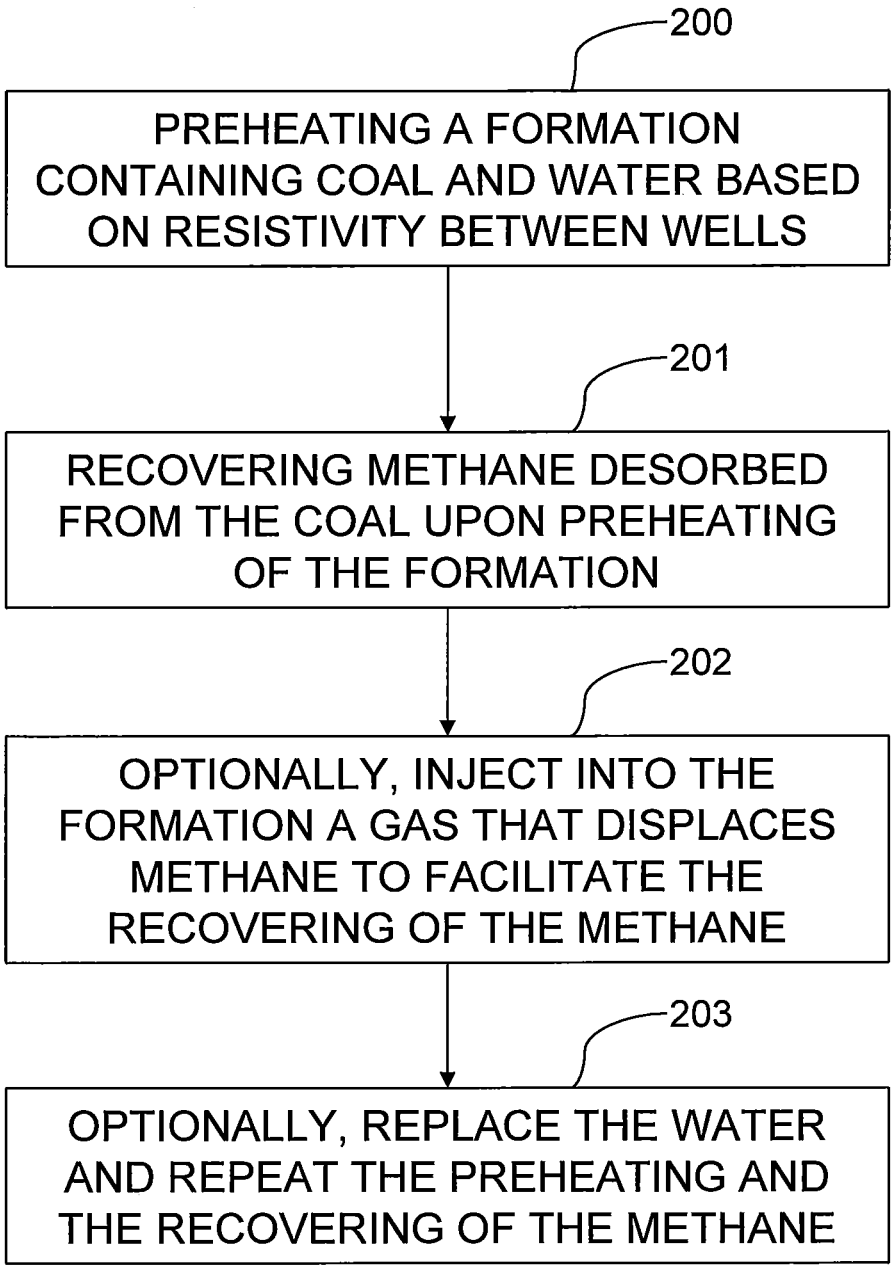
FIG. 2 is a flow chart illustrating a method of recovering methane desorbed from coal that is preheated to facilitate desorption and diffusion of the methane, according to one embodiment of the invention.

FIG. 2 illustrates a flow chart that summarizes methods described herein for recovering coal bed methane. In a preheating step 200, current is passed through a formation containing coal and water to increase temperature of the coal based on resistivity heating between wells. Production step 201 includes recovering of methane desorbed from the coal upon the formation being preheated. An optional enhancement step 202 may facilitate the production step 201 due to injection of a gas that displaces more of the methane from the coal and drives the methane through the formation to where being recovered. Further, an optional cycling step 203 includes pressurizing the formation again by replacement water injection into the formation for driving the methane through the formation to where being recovered during the production step 201 and thereafter repeating at least the preheating and production steps 200, 201.

The preferred embodiment of the present invention has been disclosed and illustrated. However, the invention is intended to be as broad as defined in the claims below. Those skilled in the art may be able to study the preferred embodiments and identify other ways to practice the invention that are not exactly as described herein. It is the intent of the inventors that variations and equivalents of the invention are within the scope of the claims below and the description, abstract and drawings are not to be used to limit the scope of the invention.

The invention claimed is:

1. A method comprising:

inserting a first electrode in a first well and a second electrode in a second well each intersecting a subterranean formation containing coal, said first and second electrodes in electrical contact with the formation;

passing electric current through water from the first well to the second well by applying a voltage across the first and second electrodes for resistive heating of the water within the formation;

heating the water such that the temperature of the coal remains below an in-situ boiling point of the water;

recovering methane desorbed from the coal due to the coal being heated by the water and without the coal being heated above a pyrolysis temperature of the coal; and dewatering of the formation concurrent with the recovering of the methane, wherein said water maintains an electrical conduit between the first and second electrodes heating water in the formation between the first and second wells.

2. The method according to claim 1, further comprising:

initial dewatering of the formation to remove the water that occurs naturally in the formation and is heated by the passing of the electric current;

injecting water back into the formation and heating the water by reapplying the voltage across the first and second wells; and recovering additional amounts of the methane desorbed from the coal upon subsequent dewatering to remove the replacement water from the formation.

3. The method according to claim 1, further comprising injecting a gas into the formation to displace the methane in order to facilitate the recovering of the methane.

4. The method according to claim 1, wherein the first and second wells are spaced apart such that the resistive heating extends across at least 100 meters between the first and second wells.

5. The method according to claim 1, wherein the coal between the first and second wells upon being heated stays below a maximum of 200° C. prior to and during the recovering.

6. The method according to claim 1, further comprising directing microwave energy into the formation to contribute to the coal being heated.

7. The method according to claim 1, further comprising directing microwave energy into the formation during water introduction into the formation to contribute to the coal being heated.

8. The method according to claim 1, further comprising dewatering of the formation concurrent with the recovering of the methane, wherein the coal is heated such that temperature of the coal remains below an in-situ boiling point of the water upon the recovering.

9. A method comprising:

passing electric current between electrodes having a voltage difference applied and disposed spaced apart in a formation containing coal, wherein the current passes through water within the formation for resistive heating of the water;

heating the water such that temperature of the coal remains below an in-situ boiling point of the water; and recovering fluids that include both the water and methane desorbed from the coal, wherein preheating the coal as a result of the resistive heating followed by dewatering of the formation during the recovering, facilitates the methane being desorbed.

10. The method according to claim 9, wherein the methane desorbs from the coal that then remains untransformed by chemical reactions upon the recovering of the methane.

11. The method according to claim 9, wherein the coal is preheated at least 100 meters away from a wellbore through which the fluids are recovered.

12. A method comprising:

passing electric current through water from a first well to a second well by applying a voltage across the first and second wells for resistive heating of the water within a formation containing coal, wherein the electric current is passed prior to initial dewatering that removes the water occurring natural within the formation;

heating the water such that temperature of the coal remains below an in-situ boiling point of the water; and recovering methane desorbed from the coal concurrent with the initial dewatering of the formation, wherein temperature increase of the coal to facilitate desorption of the methane during the recovering is limited based on an in-situ boiling point of the water.

13. The method according to claim 12, wherein the methane desorbs from the coal leaving composition of the coal unaltered upon recovering of the methane.

* * * * *